US006889919B2

(12) United States Patent
Matsuo et al.

(10) Patent No.: US 6,889,919 B2
(45) Date of Patent: May 10, 2005

(54) FUEL INJECTION DEVICE HAVING STATIONARY CORE AND MOVABLE CORE

(75) Inventors: Tetsuharu Matsuo, Chita-gun (JP); Yoshinori Yamashita, Kariya (JP); Takayuki Hokao, Anjo (JP)

(73) Assignee: Denso Corporation (JP)

( * ) Notice: Subject to any disclaimer, the term of this patent is extended or adjusted under 35 U.S.C. 154(b) by 43 days.

(21) Appl. No.: 10/331,931

(22) Filed: Dec. 31, 2002

(65) Prior Publication Data

US 2003/0141390 A1 Jul. 31, 2003

(30) Foreign Application Priority Data

Jan. 18, 2002 (JP) ..... 2002-010211
Mar. 29, 2002 (JP) ..... 2002-094218

(51) Int. Cl.[7] ..... B05B 1/30; F02M 51/00; F02M 59/00; F02M 61/00; F02M 63/00

(52) U.S. Cl. ..... 239/585.1; 239/533.2

(58) Field of Search ..... 239/585.1, 533.2, 239/585.2, 585.3, 585.4, 585.5, 533.3, 533.6, 533.9, 533.11; 251/129.21

(56) References Cited

U.S. PATENT DOCUMENTS 5,462,231 A * 10/1995 Hall ..... 239/585.4
5,944,262 A * 8/1999 Akutagawa et al. ..... 239/585.4
5,996,910 A 12/1999 Takeda et al.
6,201,461 B1 * 3/2001 Eichendorf et al. ..... 335/256
6,616,073 B2 * 9/2003 Sugiyama ..... 239/585.1

FOREIGN PATENT DOCUMENTS

| | | |
|---|---|---|
| JP | U-4-54135 | 5/1992 |
| JP | A-11-82808 | 3/1999 |
| JP | A-11-132127 | 11/1999 |
| JP | A-11-324851 | 11/1999 |
| JP | 2000-46226 | 2/2000 |

* cited by examiner

*Primary Examiner*—Michael Mar
*Assistant Examiner*—Darren Gorman
(74) *Attorney, Agent, or Firm*—Nixon & Vanderhye PC

(57) ABSTRACT

A stationary core has a press fitting portion and is secured to an inner peripheral wall of a tubular member by press fitting, so that an outer peripheral wall of the press fitting portion of the stationary core is engaged with the inner peripheral wall of the tubular member, and a radial space is formed upstream of the press fitting portion of the stationary core between the stationary core and the tubular member. The stationary core can have a tapered annular outer surface section, which is arranged in an outer peripheral wall of a downstream end portion of the stationary core and is tapered toward a downstream end of the stationary core at a taper angle of 2 to 60 degrees to have a reduced outer diameter.

10 Claims, 6 Drawing Sheets

FUEL INJECTION DEVICE HAVING STATIONARY CORE AND MOVABLE CORE

CROSS REFERENCE TO RELATED APPLICATION

This application is based on and incorporates herein by reference Japanese Patent Application No. 2000-189171 filed on Jun. 23, 2000, Japanese Patent Application No. 2002-10211 filed on Jan. 18, 2002 and Japanese Patent Application No. 2002-94218 filed on Mar. 29, 2002.

BACKGROUND OF THE INVENTION

1. Field of the Invention

The present invention relates to a fuel injection device of an internal combustion engine.

2. Description of Related Art

FIG. 9 shows one previously proposed fuel injection device (i.e., injector) 200 of an internal combustion engine (hereinafter, simply referred to as an engine). In the fuel injection device 200, a cylindrical tubular member 202 receives a valve member 210, a movable core 212 and a stationary core 214. The tubular member 202 has a first magnetic segment 203, a magnetically resistive segment 204 and a second magnetic segment 205, which are arranged in this order from a downstream end (lower end in FIG. 9) of the tubular member 202, which is located on an injection hole 208 side. The movable core 212 reciprocates together with the valve member 210, which enables and disables injection of fuel from injection holes 208. The stationary core 214 is arranged on an upstream side of the movable core 212 in opposed relationship to the movable core 212. The stationary core 214 is secured to the tubular member 202 by welding at a weld 220.

Positioning of the stationary core 214 relative to the tubular member 202 and welding of the stationary core 214 to the tubular member 202 are time consuming and tedious operations.

Furthermore, the position of the stationary core 214 could be deviated in a reciprocating direction of the valve member 210 during the welding of the stationary core 214 to the tubular member 202. When the position of the stationary core 214 is deviated in the reciprocating direction of the valve member 210, the maximum size of a gap formed between the stationary core 214 and the movable core 212 changes. This causes device-to-device variations (i.e., injector-to-injector variations) in a fuel injection rate with respect to a predetermined control electric current waveform, so that adjustment of the fuel injection amount needs to be performed on each fuel injection device. This causes an increase in the number of assembling steps of the fuel injection device.

Another previously proposed fuel injection device is disclosed in Unexamined Japanese Patent Publication No. 11-132127. In the previously proposed fuel injection device, a stationary core (stator), a movable core (armature) and a valve member are received in a tubular member (main tubular body). When electric current is supplied to a coil arranged around the tubular member, the stationary core, the tubular member and the armature form a magnetic circuit, so that the armature is attracted to the stationary core to lift the valve member from a valve seat. In the fuel injection device, the stationary core is secured to an inner peripheral wall surface of the tubular member, for example, by press fitting the stationary core into the tubular member.

Recent years, regulations regarding emissions of the engines are being tightened. Thus, relatively precise adjustment of the fuel injection amount of the fuel injection device is required to reduce cylinder-to-cylinder variations in air-fuel ratio. The relatively precise adjustment of the fuel injection amount can be achieved in the following way. That is, the stationary core is press fitted into the tubular member while the fuel injection amount is measured, and the stationary core is secured to the tubular member at a point where a desired fuel injection amount is measured.

However, in the press fitting of the stationary core into the tubular member, an outer peripheral edge of a downstream end of the stationary core could scrape the inner peripheral wall of the tubular member, so that scraped debris falls in a fuel pressure chamber. Also, a welded connection of the tubular member can be damaged by press fitting load applied from the press fitted stationary core. Furthermore, a magnetic property of the magnetic circuit can be deteriorated by deformation of the stationary core. The placement of the scraped debris in the fuel pressure chamber and the deterioration of the magnetic property of the magnetic circuit deteriorate not only the adjustment accuracy of the fuel injection amount but also response of the fuel injection device. Furthermore, the damage to the welded connection of the tubular member causes a reduction in yield.

SUMMARY OF THE INVENTION

The present invention addresses the above disadvantages. Thus, it is an objective of the present invention to provide a fuel injection device that has a stationary core, which allows easier installation of the stationary core into a tubular member.

It is another objective of the present invention to provide a fuel injection device that allows easy adjustment of the fuel injection amount injected from the fuel injection device.

It is a further objective of the present invention to provide a fuel injection device having a reduced number of components.

It is a further objective of the present invention to provide a fuel injection device that allows improved relatively precise adjustment of the fuel injection amount.

It is a further objective of the present invention to provide a fuel injection device that shows an improved response.

To achieve the objectives of the present invention, there is provided a fuel injection device including a tubular member, a valve body, a valve member, a movable core, a stationary core and a coil. The tubular member has a first magnetic segment, a magnetically resistive segment and a second magnetic segment, which are arranged in this order from a downstream end of the tubular member. The valve body is arranged adjacent to the first magnetic segment of the tubular member and includes a fuel injection hole and a valve seat. The fuel injection hole is located at a downstream end of the valve body, and the valve seat is located upstream of the fuel injection hole. The valve member is reciprocably received in the tubular member and has an abutting portion, which is seatable against the valve seat. The abutting portion closes the fuel injection hole when the abutting portion is seated against the valve seat. The abutting portion opens the fuel injection hole when the abutting portion is lifted away from the valve seat. The movable core is arranged on an upstream side of the valve member and reciprocates together with the valve member. The stationary core is arranged in the tubular member on an upstream side of the movable core in opposed relationship to the movable core. The coil is arranged radially outward of the tubular member and generates a magnetic attractive force for attracting the movable core toward the stationary core upon energization of the coil.

The stationary core has a press fitting portion and is secured to an inner peripheral wall of the tubular member through the press fitting portion by press fitting, so that an outer peripheral wall of the press fitting portion of the stationary core is engaged with the inner peripheral wall of the tubular member. A radial space is formed upstream of the press fitting portion of the stationary core between the stationary core and the tubular member.

To achieve the objectives of the present invention, there is also provided a fuel injection device including a tubular member, a stationary core, a movable core, a coil, a valve body and a valve member. The stationary core is press fitted into the tubular member and has a tapered annular outer surface section, which is arranged in an outer peripheral wall of a downstream end portion of the stationary core and is tapered toward a downstream end of the stationary core at a taper angle of 2 to 60 degrees to have a reduced outer diameter in the tapered annular outer surface section. The movable core is arranged on a downstream side of the stationary core and is magnetically attractable to the stationary core. The coil is arranged around the tubular member and forms a magnetic circuit in the tubular member, the stationary core and the movable core. The valve body is coaxial with the tubular member. The valve body includes a fuel injection hole and a valve seat. The fuel injection hole is located at a downstream end of the valve body. The valve seat is located upstream of the fuel injection hole. The valve member moves together with the movable core and is seatable against the valve seat. The valve member closes the fuel injection hole when the valve member is seated against the valve seat. The valve member opens the fuel injection hole when the valve member is lifted away from the valve seat.

To achieve the objectives of the present invention there is also provided a fuel injection device including a tubular member, a stationary core, a movable core, a coil, a valve body and a valve member. The stationary core is press fitted into the tubular member and has a reduced diameter portion in a downstream end portion of the stationary core. An annular space is defined between an inner peripheral wall surface of the tubular member and an outer peripheral wall surface of the reduced diameter portion of the stationary core, and an axial length of the annular space is in a range of 1.0 to 10 mm. The movable core is arranged on a downstream side of the stationary core and is magnetically attractable to the stationary core. The coil is arranged around the tubular member and forms a magnetic circuit in the tubular member, the stationary core and the movable core. The valve body is coaxial with the tubular member. The valve body includes a fuel injection hole and a valve seat. The fuel injection hole is located at a downstream end of the valve body. The valve seat is located upstream of the fuel injection hole. The valve member moves together with the movable core and is seatable against the valve seat. The valve member closes the fuel injection hole when the valve member is seated against the valve seat. The valve member opens the fuel injection hole when the valve member is lifted away from the valve seat.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

First Embodiment

Figure 1:
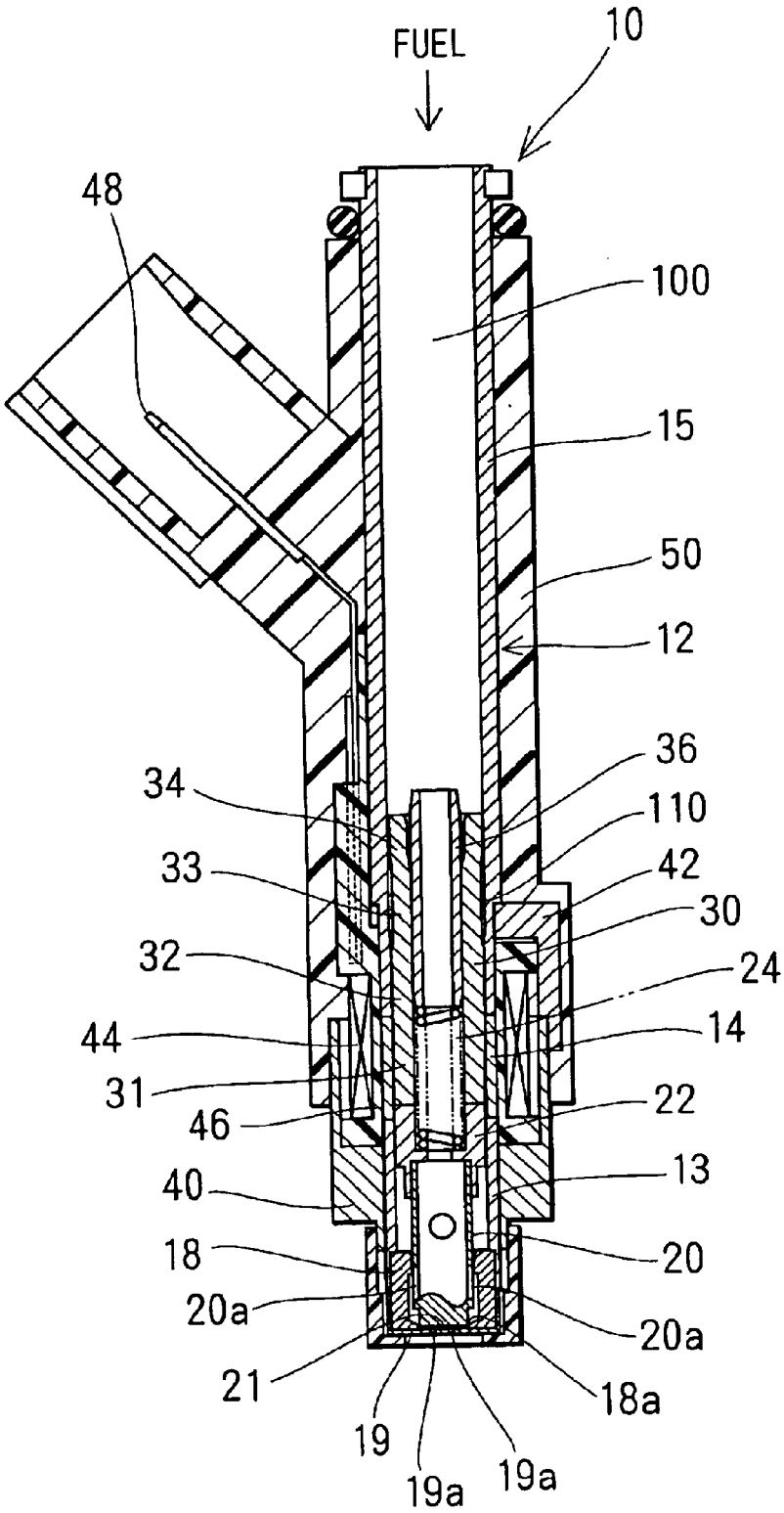
FIG. 1 is a cross sectional view of a fuel injection device according to a first embodiment of the present invention.

FIG. 1 shows a fuel injection device (i.e., injector) 10 according to a first embodiment of the present invention. A tubular member 12 is formed as a cylinder having magnetic segments and a non-magnetic segment. A fuel passage 100 extends through the tubular member 12. A valve body 18, a valve member 20, a movable core 22, a spring (urging member) 24, a stationary core 30 and an adjusting pipe 36 are received in the fuel passage 100.

Figure 2:
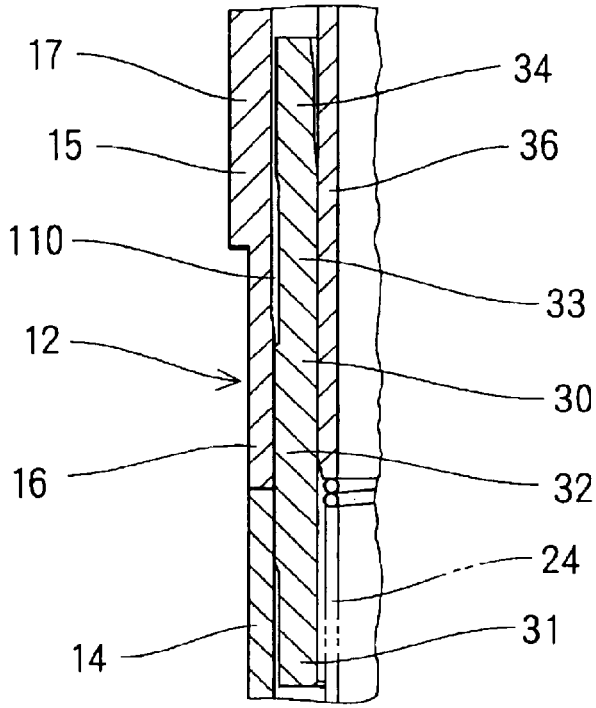
FIG. 2 is a partially enlarged cross sectional view of FIG. 1 showing a stationary core secured to a tubular member of the fuel injection device by press fitting according to the first embodiment.

The tubular member 12 has a first magnetic segment 13, a non-magnetic segment (serving as a magnetically resistive segment) 14 and a second magnetic segment 15, which are arranged in this order from a downstream end (lower end in FIG. 1) of the tubular member 12. The first magnetic segment 13 and the non-magnetic segment 14 are joined together by welding, such as laser welding. Also, the non-magnetic segment 14 and the second magnetic segment 15 are joined together by welding, such as laser welding. The non-magnetic segment 14 prevents a short circuit of a magnetic flux between the first magnetic segment 13 and the second magnetic segment 15. The valve body 18 is secured to an inner peripheral surface of a downstream end of the first magnetic segment 13 by welding. As shown in FIG. 2, the second magnetic segment 15 includes a connecting portion 16 and a receiving portion 17. The connecting portion 16 of the second magnetic segment 15 is welded (i.e., joined) to the non-magnetic segment 14, and the receiving portion 17 of the second magnetic segment 15 is arranged next to the connecting portion 16 on a side opposite to the non-magnetic segment 14 (i.e., is arranged upstream of the connecting portion 16). Furthermore, an inner diameter of the receiving portion 17 is larger than that of the connecting portion 16.

As shown in FIG. 1, a cup shaped injection hole plate 19 is secured to an outer peripheral wall of the valve body 18 by welding. The injection hole plate 19 is made as a relatively thin plate and has a plurality of injection holes 19*a* at its center.

The valve member 20 is made as a hollow cylindrical body having a closed bottom end. The valve member 20 includes an abutting portion 21 at the bottom end of the valve member 20. The abutting portion 21 of the valve member 20 is seatable against a valve seat 18*a* formed in an inner peripheral wall of the valve body 18. When the abutting portion 21 of the valve member 20 is seated against the valve seat 18*a*, the injection holes 19*a* are closed to stop fuel injection through the injection holes 19*a*. The movable core 22 is secured to an upstream end of the valve member 20, for example, by welding. The valve member 20 includes a plurality of fuel communicating holes 20*a*, which penetrate through a lateral wall of the valve member 20 on an upstream side of the abutting portion 21. Fuel, which is introduced into the vale member 20, flows outwardly through the fuel communicating holes 20*a* toward a valve arrangement, which is formed by the abutting portion 21 and the valve seat 18*a*.

The stationary core 30 is shaped as a cylindrical body. The stationary core 30 is press fitted to both the non-magnetic segment 14 and the second magnetic segment 15, so that the stationary core 30 is secured to the tubular member 12. A press fitting direction (i.e., inserting direction) of the stationary core 30 relative to the tubular member 12 is the same as a reciprocating direction of the valve member 20. The stationary core 30 opposes the movable core 22 on an upstream side of the movable core 22. A non-magnetic material is applied to an end surface of the stationary core 30, which opposes the movable core 22. The stationary core 30 serves as an engaging member, to which the movable core 22 engages.

As shown in FIG. 2, the stationary core 30 includes a first small diameter portion (downstream side small diameter portion) 31, a press fitting portion 32, a second small diameter portion (upstream side small diameter portion) 33 and a large diameter portion 34, which are arranged in this order from a downstream end (lower end in FIG. 2) of the stationary core 30. An outer diameter of the press fitting portion 32 is substantially the same as that of the large diameter portion 34. An outer diameter of each of the first and second small diameter portions 31, 33 is smaller than that of the press fitting portion 32 and is thus also smaller than that of the large diameter portion 34. The first and second small diameter portions 31, 33 do not contact an inner peripheral wall of the tubular member 12.

The press fitting portion 32 is press fitted to the inner peripheral wall of the non-magnetic segment 14 and the inner peripheral wall of the connecting portion 16 of the second magnetic segment 15. A wall thickness of the press fitting portion 32 is larger than that of a portion of the non-magnetic segment 14, which is engaged with the press fitting portion 32, and is also larger that of the connecting portion 16 of the second magnetic segment 15. At a state before press fitting of the stationary core 30 into the tubular member 12, an outer diameter of the press fitting portion 32 is larger than an inner diameter of the non-magnetic segment 14 and is also larger than an inner diameter of the connecting portion 16 of the second magnetic segment 15. An annular space (radial space) 110 is formed between the outer peripheral wall of the second small diameter portion 33 and the inner peripheral wall of the second magnetic segment 15. An outer diameter of the large diameter portion 34 is substantially the same as that of the press fitting portion 32. The inner diameter of the receiving portion 17 of the second magnetic segment 15, which is radially opposed to the large diameter portion 34, is larger than the inner diameter of the connecting portion 16 of the second magnetic segment 15. Thus, the large diameter portion 34 is not press fitted to the receiving portion 17, and thus a small space (radial space) is formed between the large diameter portion 34 and the receiving portion 17. The small space between the large diameter portion 34 and the receiving portion 17 is sized such that debris generated during the press fitting of the stationary core 30 cannot pass through the small space. Alternatively, the large diameter portion 34 and the receiving portion 17 can lightly contact with each other by a force smaller than the press fitting force.

As shown in FIG. 1, the adjusting pipe 36 is press fitted into the stationary core 30. One end of the spring 24 is engaged with the adjusting pipe 36, and the other end of the spring 24 is engaged with the movable core 22. By adjusting an amount of insertion of the adjusting pipe 36 into the stationary core 30, a spring load of the spring 24 can be adjusted. The spring 24 urges the valve member 20 against the valve seat 18*a*.

First and second magnetic members 40, 42 are magnetically connected together and are arranged radially outward of a coil 44. The first magnetic member 40 is magnetically connected to the first magnetic segment 13, and the second magnetic member 42 is magnetically connected to the second magnetic segment 15. The stationary core 30, the movable core 22, the first magnetic segment 13, the first and second magnetic members 40, 42 and the second magnetic segment 15 constitute a magnetic circuit.

A spool 46 is secured around an outer peripheral surface of the tubular member 12, and the coil 44 is wound around the spool 46. A terminal 48 is electrically connected to the coil 44 and supplies drive electric current to the coil 44. A resin housing 50 covers the tubular member 12 and an outer periphery of the coil 44.

Fuel, which is supplied into the fuel passage 100 from an upstream end (top end in FIG. 1) of the tubular member 12, passes through a fuel passage in the adjusting pipe 36, a fuel passage in the stationary core 30, a fuel passage in the movable core 22, a fuel passage in the valve member 20, the fuel communicating holes 20*a* and an opening, which is formed between the abutting portion 21 and the valve seat 18*a* when the abutting portion 21 is lifted away from the valve seat 18*a*. Then, the fuel is discharged through the injection holes 19*a*.

In the fuel injection device 10, when the coil 44 is deenergized, the valve member 20 is moved in a valve closing direction (downward direction in FIG. 1) by the spring 24, so that the abutting portion 21 of the valve member 20 is seated against the valve seat 18*a* to close the injection holes 19*a* to stop fuel injection.

When the coil 44 is energized, a magnetic flux flows through the magnetic circuit formed by the stationary core 30, the movable core 22, the first magnetic segment 13, the first and second magnetic members 40, 42 and the second magnetic member 15. Thus, a magnetic attractive force is generated between the stationary core 30 and the movable core 22. Then, the valve member 20 moves together with the movable core 22 toward the stationary core 30, and the abutting portion 21 is lifted away from the vale seat 18*a*. In this way, the fuel is injected through the injection holes 19*a*. A maximum amount of lift of the valve member 20 is limited when the moveable core 22 engages the stationary core 30.

In the first embodiment, as described above, the stationary core 30 includes the press fitting portion 32 and the first and second small diameter portions 31, 33. Each of the first and second small diameter portions 31, 33 has the outer diameter smaller than that of the press fitting portion 32 and does not contact with the inner peripheral wall surface of the tubular member 12. Furthermore, the first and second small diameter portions 31, 33 are arranged on opposed axial ends of the press fitting portion 32. That is, the stationary core 30 is press fitted to the inner peripheral wall of the tubular member 12 at the press fitting portion 32 of the stationary core 30, which is the part of the stationary core 30. With this arrangement, the axial length of the portion of the stationary core 30, which is press fitted or secured to the tubular member 12, is reduced. Thus, a press fitting force applied to the stationary core 30 at the time of press fitting the stationary core 30 into the tubular member 12 is advantageously reduced. As a result, the press fitting of the stationary core 30 is eased. Furthermore, in the first embodiment, the outer peripheral wall of the stationary core 30 is processed to form the press fitting portion 32. Since the processing of the outer peripheral wall of the stationary core 30 is easier than processing of the inner peripheral wall, the stationary core 30 can be easily processed.

In an axial region between the press fitting portion 32 and the large diameter portion 34 of the stationary core 30, the annular space 110 is formed between the outer peripheral wall of the second small diameter portion 33 of the stationary core 30 and the inner peripheral wall of the second magnetic segment 15. Thus, the debris, which may be generated during the press fitting of the stationary core 30 to the tubular member 12, can be retained in the annular space 110. In this way, the debris is restrained from moving to the valve arrangement that includes the valve seat 18*a* and the valve member 20, so that clogging of the debris at the valve arrangement can be restrained.

Second Embodiment

Figure 3:
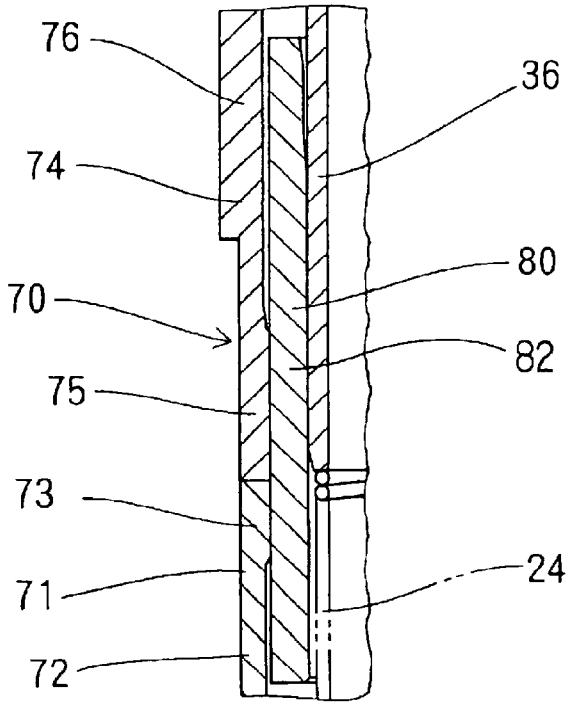
FIG. 3 is a cross sectional view similar to FIG. 2 showing a stationary core secured to a tubular member of a fuel injection device by press fitting according to a second embodiment of the present invention.

FIG. 3 shows a second embodiment of the present invention. Components similar to those discussed with reference to the first embodiment will be indicated by the similar numerals. A stationary core 80 is secured to a tubular member 70 by press fitting. The movable core 22 engages the stationary core 80, so that a maximum amount of lift of the valve member 20 is limited.

A non-magnetic segment 71 and a second magnetic segment 74 of the tubular member 70 are joined together by welding. The non-magnetic segment 71 has a downstream portion 72 and a connecting portion 73, which are arranged in this order from a downstream end of the non-magnetic segment 71. The connecting portion 73 of the non-magnetic segment 71 is joined to a connecting portion 75 of the second magnetic member 74. An inner diameter of the connecting portion 73 of the non-magnetic segment 71 is smaller than that of the downstream portion 72 of the non-magnetic segment 71 and is substantially the same as the inner diameter of the connecting portion 75 of the second magnetic member 74.

The second magnetic segment 74 includes the connecting portion 75 and a receiving portion 76, which are arranged in this order from the non-magnetic member 71 side of the second magnetic member 74. The connecting portion 75 is joined to the connecting portion 73 of the non-magnetic segment 71. An inner diameter of the receiving portion 76 of the second magnetic segment 74 is larger than that of the connecting portion 75 of the second magnetic segment 74. An outer diameter of the stationary core 80 is constant in a reciprocating direction of the valve member 20. Thus, an outer diameter of a press fitting portion 82 of the stationary core 80 is the same as that of the rest of the stationary core 80, and the press fitting portion 82 of the stationary core 80 is press fitted to the tubular member 70 at the connecting portions 73, 75. A wall thickness of the press fitting portion 82 of the stationary core 80, which is press fitted to the tubular member 70, is greater than that of the connecting portions 73, 75, to which the stationary core 80 is press fitted.

In each of the above embodiments of the present invention, the stationary core is secured to the tubular member by press fitting, so that the securing of the stationary core to the tubular member according to the above embodiments is easier than securing of the stationary core to the tubular member by welding. Furthermore, the position of the stationary core is determined by the press fitting, so that the stationary core can be relatively precisely positioned. The maximum size of the gap formed between the movable core and the stationary core can be relatively precisely set, so that it is possible to reduce device-to-device variations in magnetic attractive force between the stationary core and the moveable core. Thus, the fuel injection amount of each fuel injection device can be easily adjusted.

The movable core engages the stationary core, which is relatively precisely positioned, so that device-to-device variations in the maximum amount of lift of the valve member can be restrained. Thus, the fuel injection amount of each fuel injection device can be easily adjusted. Furthermore, the stationary core serves as the engaging member, to which the movable core engages, so that the number of components can be reduced.

In the above embodiments, the valve member 20 is a hollow member, so that the weight of the valve member 20 is reduced. Thus, shocks applied to the stationary core at the time of engaging the movable core to the stationary core are reduced. As a result, positional deviation of the stationary core can be restrained.

In the above embodiments, the wall thickness of the stationary core is greater than the thickness of the tubular member at the press fitting portion of the stationary core, which is secured to the tubular member, so that the tubular member is deformed upon press fitting of the stationary core without causing substantial deformation of the stationary core. The deformation of the tubular member can restrain changes in the magnetic attractive force between the stationary core and the movable core.

In the present invention, the press fitting portion of the stationary core, which is secured to the tubular member, can be modified to have a wall thickness equal to or smaller than the wall thickness of the tubular member.

In the above embodiments, the stationary core serves as the engaging portion, to which the movable core engages. Alternatively, it is possible to engage the movable core to an engaging member, which is separate from the stationary core and is positioned by the stationary core. Furthermore, the movable core can engage to an engaging member, which is not positioned by the stationary core.

In the above embodiments, the tubular member is made by joining the corresponding segments. Alternatively, the first magnetic segment, the non-magnetic segment and the second magnetic segment can be made by heating and thus demagnetizing a segment of a single component made from a compound magnetic material to form the magnetically resistive segment, i.e., the non-magnetic segment.

Third Embodiment

Figure 4:
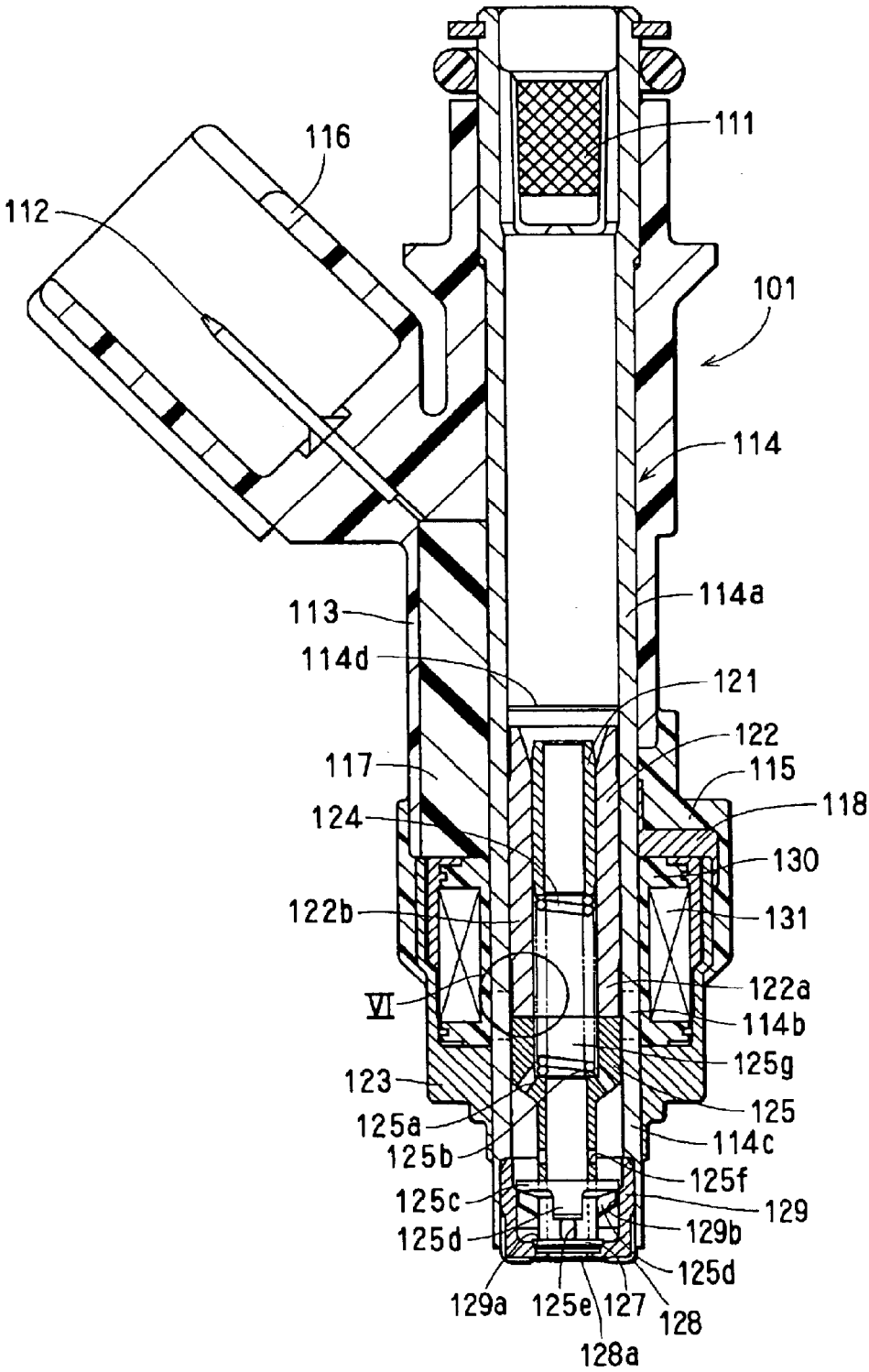
FIG. 4 is a cross sectional view of a fuel injection device according to a third embodiment of the present invention.

FIG. 4 shows a fuel injection device 101 according to a third embodiment of the present invention.

A valve body 129, a valve member 127, a movable core (armature) 125, a stationary core (stator) 122, a spring 124, an adjusting pipe 121 and a filter 111 are coaxially received in a cylindrical tubular member (main tubular body) 114.

The tubular member 114 is a tubular component having magnetic sections and a non-magnetic section and is made, for example, of a compound magnetic material. A portion of the tubular member 114 is heated to demagnetize that portion, so that a first magnetic segment 114*c*, a non-magnetic segment 114*b* and a second magnetic segment 114*a* are formed in the tubular member 114 in this order from a downstream end (lower end in FIG. 4) of the tubular member 114. The movable core 125 is received in the tubular member 114 such that the movable core 125 is placed adjacent to a border between the non-magnetic segment 114*b* and the first magnetic segment 114*c*. The valve body 129 and an injection hole plate 128 are arranged at a downstream end of the first magnetic segment 114*c*. The tubular member 114 and the valve body 129 could cooperate together to serve as a valve body. A filter 111 is fitted into an upstream end of the tubular member 114, which is located at a top end in FIG. 4, to remove foreign particles contained in fuel. A downstream region of an inner peripheral wall of the tubular member 114, which is located on the downstream side of a stepped portion 114*d*, has an inner diameter smaller than that of an upstream region of the inner peripheral wall of the tubular member 114, which is located on the upstream side of the stepped portion 114*d*.

Figure 5:
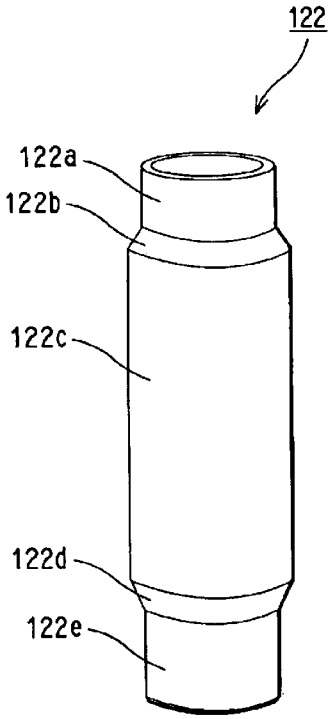
FIG. 5 is a perspective view of a stationary core according to the third embodiment.

As shown in FIG. 5, the stationary core 122 is a cylindrical body made of a ferromagnetic material, such as magnetic stainless. An armature engaging surface of the stationary core 122 has a chromium thin layer, which is plated to the armature engaging surface of the stationary core 122. A first small diameter cylindrical outer surface section 122*a*, a first tapered annular outer surface section 122*b*, a large diameter cylindrical outer surface section 122*c*, a second tapered annular outer surface section 122*d* and a second small diameter cylindrical outer surface section 122*e* are formed in an outer peripheral wall of the stationary core 122 in this order from an upstream end (top end in FIG. 5) of the stationary core 122. An outer peripheral edge of an armature side end of the stationary core 122 is chamfered. The second tapered annular outer surface section 122*d* and the second small diameter cylindrical outer surface section 122*e* serves as a downstream end portion of the stationary core 122.

Figure 6:
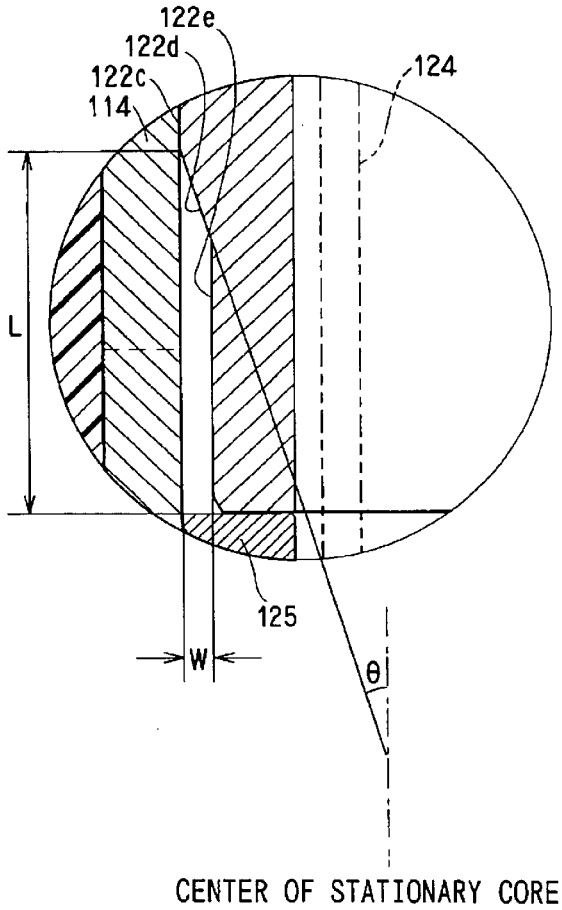
FIG. 6 is an enlarged view taken from a circled area VI in FIG. 4.

A taper angle θ of the second tapered annular outer surface section 122*d* shown in FIG. 6 is in a range of 2 to 60 degrees. This range of the tapered angle θ is selected to avoid damage to the inner peripheral wall of the tubular member 114 by the outer peripheral wall of the stationary core 122 during press fitting of the stationary core 122 into the tubular member 114.

A radial width W of an annular space (radial space) between the second small diameter cylindrical outer surface section 122*e* and the inner peripheral wall surface of the tubular member 114 is in a range between 0.05 to 0.40 mm. The radial width W of the annular space is the minimum width that does not cause a substantial reduction in a size of the armature attracting surface of the stationary core 122.

The second tapered annular outer surface section 122*d* and the second small diameter cylindrical outer surface section 122*e* allow formation of the annular space between the outer peripheral wall surface of the stationary core 122 and the inner peripheral wall of the tubular member 114. An axial length L of the annular space is in a range between 1.0 to 10 mm. The axial length L of the annular space is selected in consideration of effects on a magnetic property of the stationary core 122. That is, when the axial length L of the annular space is less than 1.0 mm, deformation of the stationary core 122 will occur adjacent to the armature side end surface of the stationary core 122 due to friction between the inner peripheral wall surface of the tubular member 114 and the large diameter cylindrical outer surface section 122*c*. This will cause deterioration of the magnetic property of the stationary core 122. On the other hand, when the axial length L of the annular space is greater than 10 mm, a magnetic flux is substantially detoured due to the annular space, so that the magnetic property of the stationary core 122 is deteriorated.

As shown in FIG. 4, the adjusting pipe 121 is press fitted into the stationary core 122 and is thus secured to the inner peripheral wall of the stationary core 122. Alternative to this, the adjusting pipe can be threadably secured to the stationary core.

With reference to FIG. 4, a spool 130 made of a resin material is arranged around the outer peripheral wall of the tubular member 114, and a coil 131 is wound around the spool 130. A connector 116 is formed to protrude from a first resin-molded sheath 113 formed around the outer peripheral wall of the tubular member 114. A terminal 112, which is electrically connected to the coil 131, is embedded in the connector 116. The terminal 112 is partially covered with a rib 117 made of a resin material.

A first magnetic member 123 covers an outer periphery of the coil 131. A second magnetic member 118 is located upstream of the coil 131 and extends 250 degrees about the tubular member 114 in an imaginary plane that is perpendicular to the axis of the tubular member 114 without overlapping with the rib 117. A second resin-molded sheath 115 is connected to the first resin-molded sheath 113 formed around the magnetic members 118, 123.

The cylindrical valve body 129 is press fitted into a downstream end of the tubular member 114 and is secured to the inner peripheral wall of the tubular member 114, for example, by laser welding. An inner peripheral wall of the valve body 129 has a tapered annular wall surface 129*a* and a cylindrical wall surface 129*b*. The tapered annular wall surface 129*a* is tapered toward fuel injection holes 128*a* of the injection hole plate 128. The cylindrical wall surface 129*b* is formed upstream of the tapered annular wall surface 129*a*. The tapered annular wall surface 129*a* is tapered in a fuel injection direction and forms a valve seat, against which an abutting portion of the valve member 127 is seatable. An internal space located upstream of the tapered annular wall surf ace 129*a* in the valve body 129 forms a fuel pressure chamber of the present invention.

The injection hole plate 128 has a cup-shape and is press fitted into the first magnetic segment 114*c*. The injection hole plate 128 is secured to the inner peripheral wall of the first magnetic segment 114*c* by laser welding such that the injection hole plate 128 is engaged with the downstream end surface of the valve body 129. The injection hole plate 128 is made as a relatively thin plate and has the injection holes 128*a* at its center.

The valve member 127 includes the disk shaped abutting portion and a cylindrical insertion portion. An outer peripheral surface of the abutting portion of the valve member 127 includes a cylindrical surface and a tapered annular surface, and the tapered annular surface of the valve member 127 is seatable against the tapered annular wall surface 129*a* of the valve body 129.

The movable core (armature) 125 is a tubular member made of a ferromagnetic material, such as magnetic stainless. The movable core 125 is secured to the outer peripheral surface of the upstream end of the valve member 127, i.e., the outer peripheral surface of the insertion portion of the valve member 127 by laser welding. An upstream region of the movable core 125 has an outer diameter larger than that of a downstream region of the movable core 125. A flange, which is in sliding engagement with the inner peripheral wall of the tubular member 114, is provided at an outer periphery of an upstream end of the movable core 125. The downstream region of the movable core 125 includes a cylindrical portion and a guide that extends radially outward from the cylindrical portion. The guide of the movable core 125 includes four ribs 125*d* and an annular portion 125*c*. The four ribs 125*d* are circumferentially arranged at 90 degree intervals, and the annular portion 125*c* connects the ribs 125*d*. An outer peripheral surface of the guide of the movable core 125 is slidably engaged with the inner peripheral wall surface of the valve body 129. The flange of the movable core 125 arranged at the upstream region of the movable core 125 is slidably engaged with the inner peripheral wall surface of the tubular member 114, and the guide of the movable core 125 is slidably engaged with the inner peripheral wall surface of the valve body 129. The above arrangement defines a reciprocating path of the movable core 125 and the valve member 127. An annular projection axially projects from the upstream end of the movable core 125 and engages the stationary core 122 such that an air gap can be formed between the movable core 125 and the stationary core 122. The stationary core engaging surface of the annular projection of the movable core 125 has a chromium thin layer, which is plated to the stationary core engaging surface of the annular projection of the movable core 125. An internal space 125*g* of the movable core 125 is communicated to the outside through fuel passages 125*a*, 125*e*, 125*f*. An inner peripheral stepped surface of the movable core 125 forms a spring seat 125*b*.

One end of the spring 124 is engaged with the spring seat 125*b* of the movable core 125, and the other end of the spring 124 is engaged with a downstream end surface of the adjusting pipe 121, so that the spring 124 urges the valve member 127 through the movable core 125 against the tapered annular wall surface 129*a*, which serves as the valve seat. An urging force of the spring 124 is adjusted by adjusting an amount of insertion of the adjusting pipe 121 within the stationary core 122.

The fuel, which flows into the tubular member 114 through the filter 111, is conducted from the fuel passage 125*e* to the fuel pressure chamber through an internal space of the adjusting pipe 121, an internal space of the stationary core 122 and the internal space 125*g* of the movable core 125. Thereafter, the fuel is conducted to a valve arrangement, which includes the abutting portion of the valve member 127 and the valve seat of the valve body 129. When the abutting portion of the valve member 127 is seated against the valve seat of the valve body 129, the fuel pressure chamber and the injection holes 128*a* are discommunicated from each other. On the other hand, when the abutting portion of the valve member 127 is lifted away from the vale seat of the valve body 129, the fuel pressure chamber and the injection holes 128*a* are communicated with each other. The arrangement of the fuel injection device 101 is described above.

Next, operation of the fuel injection device 101 will be described.

When the coil 131 is energized, the movable core 125, the stationary core 122, the magnetic segments 114*a*, 114*c* and the magnetic members 118, 123 form a magnetic circuit, through which a magnetic flux flows during the energization of the coil 131. At that time, the valve member 127 is attracted toward the stationary core 122 against the urging force of the spring 124, so that the abutting portion of the valve member 127 is lifted away from the valve seat to inject fuel through the injection holes 128*a*.

When the coil 131 is deenergized, the valve member 127 is urged by the urging force of the spring 124 in the valve closing direction, so that the abutting portion of the valve member 127 is seated against the valve seat of the valve body 129. Thus, the fuel injection through the injection holes 128*a* stops.

Next, installation of the stationary core 122 into the tubular member 114 will be described.

The stationary core 122 is inserted into the tubular member 114 from the upstream end of the tubular member 114 after the spool 130, the coil 131 and the magnetic members 118, 123 are assembled to the outer peripheral wall of the tubular member 114, and the valve body 129, the valve member 127, the movable core 125 and the spring 124 are received in the tubular member 114. When the stationary core 122 is inserted to a location downstream of the stepped portion 114*d*, the large diameter cylindrical outer surface section 122*c* of the stationary core 122 is urged against the inner peripheral wall surface of the tubular member 114, so that a relatively large frictional force is generated between the large diameter cylindrical outer surface section 122*c* of the stationary core 122 and the inner peripheral wall surface of the tubular member 114. A load greater than the frictional force is then applied to the stationary core 122, so that the stationary core 122 is further press fitted to a location further downstream of the stepped portion 114*d* where a predetermined needle lift can be achieved. Then, the press fitting of the stationary core 122 is completed, and the stationary core 122 is secured to the inner peripheral wall of the tubular member 114.

As described above, the second tapered annular outer surface section 122*d* is formed in the outer peripheral wall of the stationary core 122, and the taper angle of the second tapered annular outer surface section 122*d* is set in the range of 2 to 60 degrees. Because of this arrangement, in the press fitting of the stationary core 122 into the tubular member 114, scraping of the inner peripheral wall of the tubular member 114 by the stationary core 122 can be advantageously restrained. Furthermore, the load required to press fit the stationary core 122 can be advantageously reduced, so that damage to the welded connection between the first magnetic member 123 and the tubular member 114 can be restrained, and fine adjustment of the amount of insertion of the stationary core 122 is possible. That is, the fuel injection device 101 of the third embodiment allows relatively precise adjustment of the fuel injection amount.

The outer peripheral wall surface of the stationary core 122 adjacent to the armature side end of the stationary core 122 does not engage the inner peripheral wall surface of the tubular member 114 during the press fitting of the stationary core 122. Thus, deformation of the armature side end of the stationary core 122 will not occur. As a result, the magnetic property of the stationary core 122 is not degraded by the press fitting of the stationary core 122. Furthermore, the annular space, which is formed between the outer peripheral wall surface of the stationary core 122 and the inner peripheral wall surface of the tubular member 114, has the axial length equal to or less than 10 mm. Thus, it is possible to avoid the deterioration of the magnetic property of the stationary core 122 that could be induced by the magnetic flux, which passes through the stationary core 122 and the tubular member 114 and is detoured due to the annular space. As a result, the fuel injection device 101 according to the third embodiment can achieve the improved response.

Fourth Embodiment

Figure 7:
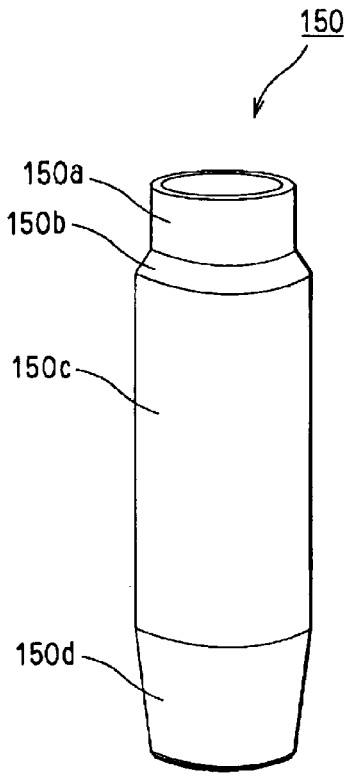
FIG. 7 is a perspective view of a stationary core according to a fourth embodiment of the present invention.
Figure 8:
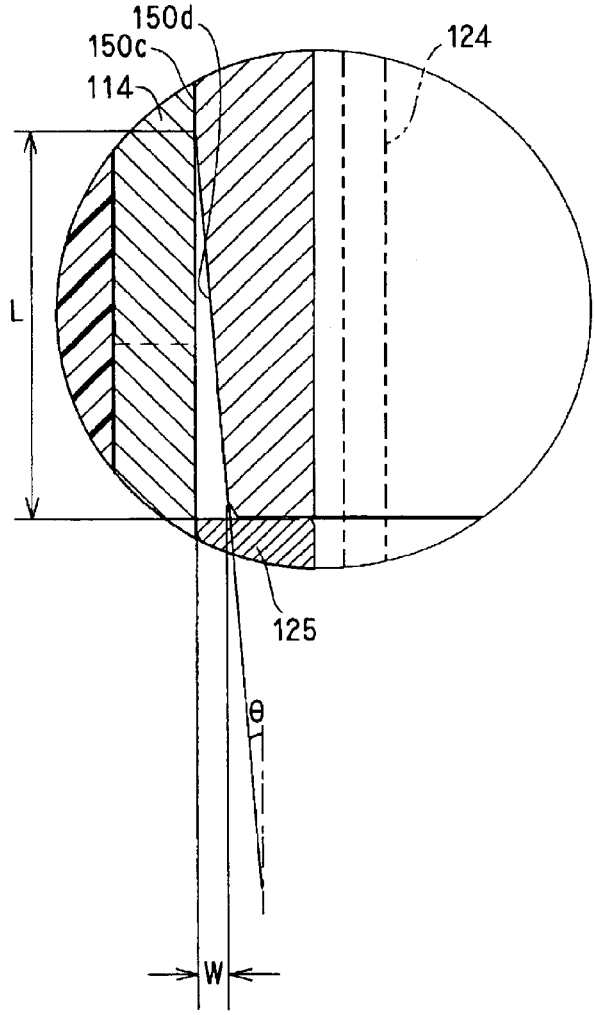
FIG. 8 is an enlarged view similar to FIG. 6 showing the stationary core according to the fourth embodiment.
Figure 9:
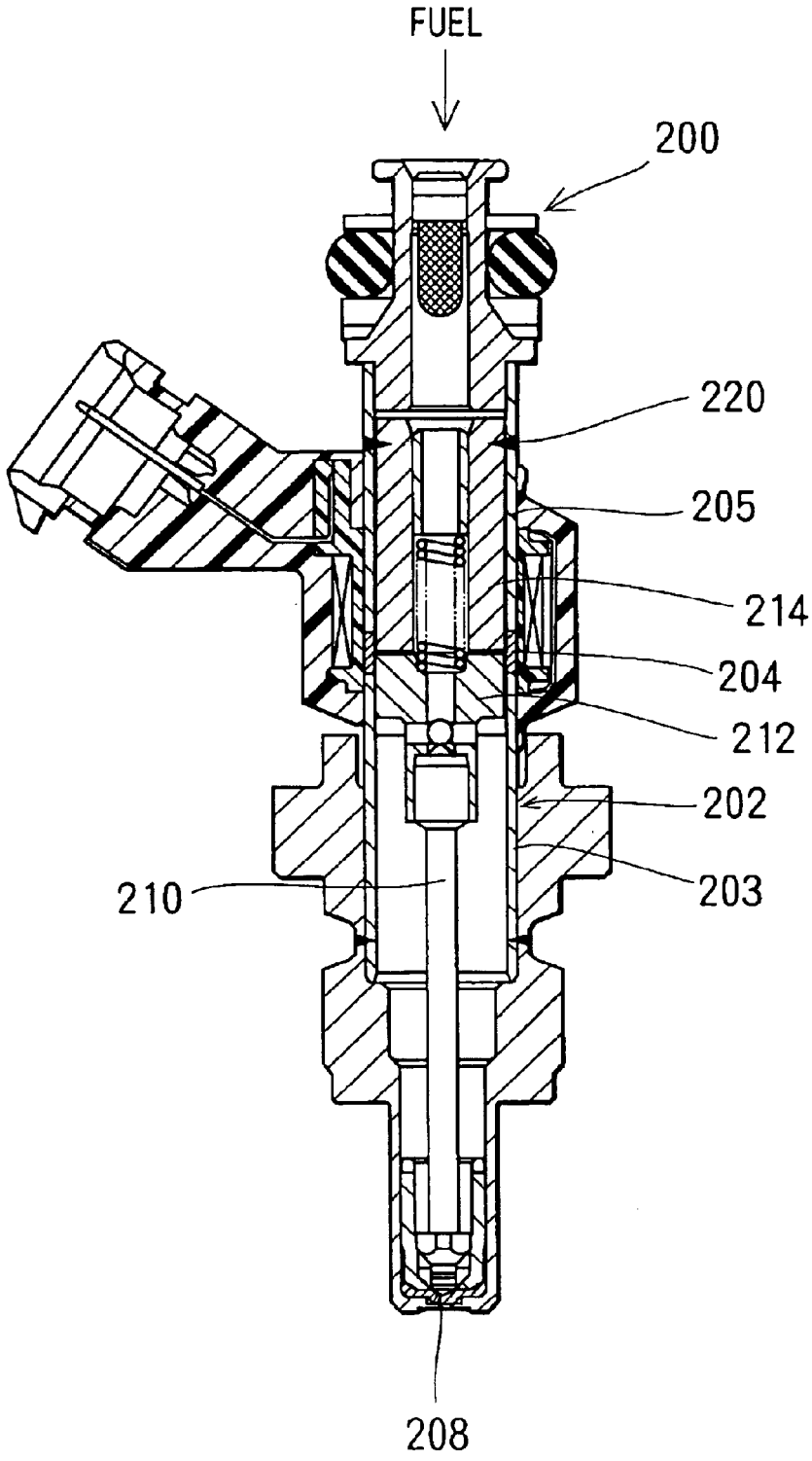
FIG. 9 RELATED ART
FIG. 9 is a cross sectional view of a previously proposed fuel injection device.

FIGS. 7 and 8 show a stationary core 150 of a fuel injection device according to a fourth embodiment. Since the arrangement of the fuel injection device other than the stationary core 150 is substantially the same as that of the fuel injection device of the third embodiment, the arrangement of the fuel injection device other than the stationary core 150 will not be described.

The stationary core 150 is a cylindrical body made of a ferromagnetic material, such as magnetic stainless. An armature engaging surface of the stationary core 150 has a chromium thin layer, which is plated to the armature engaging surface of the stationary core 150. A first small diameter cylindrical outer surface section 150*a*, a first tapered annular outer surface section 150*b*, a large diameter cylindrical outer surface section 150*c* and a second tapered annular outer surface section 150*d* are formed in an outer peripheral wall of the stationary core 150 in this order from an upstream end (top end in FIG. 7) of the stationary core 150. An outer peripheral edge of an armature side end of the stationary core 150 is chamfered. A taper angle θ of the second tapered annular outer surface section (serving as a downstream end portion of the stationary core) 150*d* shown in FIG. 8 is in a range of 2 to 60 degrees. This range of the tapered angle θ is selected to avoid damage to the inner peripheral wall of the tubular member 114 during press fitting of the stationary core 150 into the tubular member 114.

A radial width W of an annular space between the second tapered annular outer surface section 150*d* and the inner peripheral wall surface of the tubular member 114 is in a range between 0.05 to 0.40 mm. The radial width W of the annular space is the minimum width that does not cause a substantial reduction in a size of the armature attracting surface of the stationary core 150.

The second tapered annular outer surface section 150*d* allows formation of the annular space between the outer peripheral wall surface of the stationary core 150 and the inner peripheral wall of the tubular member 114. An axial length L of the annular space is in a range between 1.0 to 10 mm. The axial length L of the annular space is selected in consideration of effects on a magnetic property of the stationary core 150. That is, when the axial length L of the annular space is less than 1.0 mm, deformation of the stationary core 150 will occur adjacent to the armature side end surface of the stationary core 150 due to friction between the inner peripheral wall surface of the tubular member 114 and the large diameter cylindrical outer surface section 150*c*. This will cause deterioration of the magnetic property of the stationary core 150. On the other hand, when the axial length L of the annular space is greater than 10 mm, a magnetic flux is substantially detoured due to the annular space, so that the magnetic property of the stationary core 150 is deteriorated.

As described above, the second tapered annular outer surface section 150*d* is formed in the outer peripheral wall of the stationary core 150, and the taper angle of the second tapered annular outer surface section 150*d* is set in the range of 2 to 60 degrees. Because of this arrangement, in the press fitting of the stationary core 150 into the tubular member 114, scraping of the inner peripheral wall of the tubular member 114 by the stationary core 150 can be advantageously restrained. Furthermore, the load required to press fit the stationary core 150 can be advantageously reduced, so that damage to the welded connection between the first magnetic member 123 and the tubular member 114 can be restrained, and fine adjustment of the amount of insertion of the stationary core 150 is possible. That is, the fuel injection device of the fourth embodiment allows relatively precise adjustment of the fuel injection amount.

The outer peripheral wall surface of the stationary core 150 adjacent to the armature side end of the stationary core 150 does not engage the inner peripheral wall surface of the tubular member 114 during press fitting of the stationary core 150. Thus, deformation of the armature side end of the stationary core 150 will not occur. As a result, the magnetic property of the stationary core 150 is not degraded by the press fitting of the stationary core 150. Furthermore, the annular space, which is formed between the outer peripheral wall surface of the stationary core 150 and the inner peripheral wall surface of the tubular member 114, has the axial length equal to or less than 10 mm. Thus, it is possible to avoid the deterioration of the magnetic property of the stationary core 150 that could be induced by the magnetic flux, which passes through the stationary core 150 and the tubular member 114 and is detoured due to the annular space. As a result, the fuel injection device 101 according to the fourth embodiment can achieve the improved response.

Furthermore, manufacturing of the second tapered annular outer surface section 150*d* of the stationary core 150 according to the fourth embodiment is easier than manufacturing of the second tapered annular outer surface section 122*d* and the second small diameter cylindrical outer surface section 122*e* according to the third embodiment.

Additional advantages and modifications will readily occur to those skilled in the art. The invention in its broader terms is therefore, not limited to the specific details, representative apparatus, and illustrative examples shown and described.

What is claimed is:

1. A fuel injection device comprising:

a tubular member that has a first magnetic segment, a magnetically resistive segment and a second magnetic segment, which are arranged in this order from a downstream end of the tubular member;

a valve body that is arranged adjacent to the first magnetic segment of the tubular member and includes a fuel injection hole and a valve seat, wherein the fuel injection hole is located at a downstream end of the valve body, and the valve seat is located upstream of the fuel injection hole;

a valve member that is reciprocably received in the tubular member and has an abutting portion, which is seatable against the valve seat, wherein:

the abutting portion closes the fuel injection hole when the abutting portion is seated against the valve seat; and the abutting portion opens the fuel injection hole when the abutting portion is lifted away from the valve seat;

a movable core that is arranged on an upstream side of the valve member and reciprocates together with the valve member;

a stationary core that is arranged in the tubular member on an upstream side of the movable core in opposed relationship to the movable core; and a coil that is arranged radially outward of the tubular member and generates a magnetic attractive force for attracting the movable core toward the stationary core upon energization of the coil, wherein the stationary core has a press fitting portion and is secured to an inner peripheral wall of the tubular member through the press fitting portion by press fitting, so that an outer peripheral wall of the press fitting portion of the stationary core is engaged with the inner peripheral wall of the tubular member, and a radial space is formed upstream of the press fitting portion of the stationary core between the stationary core and the tubular member.

2. A fuel injection device according to claim 1, wherein the stationary core limits an amount of lift of the valve member when the movable core engages the stationary core.

3. A fuel injection device according to claim 1, wherein the valve member has a hollow interior.

4. A fuel injection device according to claim 1, wherein a wall thickness of the press fitting portion of the stationary core is larger than a wall thickness of an opposed portion of the tubular member, which is radially opposed to the press fitting portion.

5. A fuel injection device according to claim 1, wherein the press fitting portion of the stationary core extends only partially along a length of the stationary core in an axial direction of the stationary core.

6. A fuel injection device according to claim 5, wherein:

the stationary core further includes an upstream side small diameter portion, which is located on an upstream side of the press fitting portion of the stationary core; and the upstream side small diameter portion has an outer diameter smaller than an outer diameter of the press fitting portion of the stationary core and is radially spaced away from the inner peripheral wall of the tubular member.

7. A fuel injection device according to claim 6, wherein:

the stationary core further includes a large diameter portion that is located upstream of the upstream side small diameter portion; and the large diameter portion has an outer diameter larger than the outer diameter of the upstream side small diameter portion and is radially spaced away from the inner peripheral wall of the tubular member.

8. A fuel injection device according to claim 6, wherein:

the stationary core further includes a downstream side small diameter portion, which is located on a downstream side of the press fitting portion of the stationary core; and the downstream side small diameter portion has an outer diameter smaller than the outer diameter of the press fitting portion of the stationary core and is radially spaced away from the inner peripheral wall of the tubular member.

9. A fuel injection device according to claim 6, wherein the second magnetic segment includes:

a connecting portion, which is joined to the magnetically resistive segment and is engaged with the press fitting portion of the stationary core; and a receiving portion, which extends from the connecting portion of the second magnetic segment on an upstream side of the connecting portion of the second magnetic segment and has an inner diameter larger than an inner diameter of the connecting portion of the second magnetic segment, wherein the receiving portion is radially spaced away from the stationary core.

10. A fuel injection device according to claim 1, wherein:

an outer diameter of the press fitting portion of the stationary core is substantially the same as an outer diameter of the rest of the stationary core;

the magnetically resistive segment of the tubular member includes:

a connecting portion that is joined to the second magnetic segment and is engaged with the press fitting portion of the stationary core; and a downstream portion that extends from the connecting portion of the magnetically resistive segment on a downstream side of the connection portion of the magnetically resistive segment and has an inner diameter larger than an inner diameter of the connecting portion of the magnetically resistive segment, wherein the downstream portion of the magnetically resistive segment is radially spaced away from the stationary core; and the second magnetic segment of the tubular member includes:

a connecting portion that is joined to the connecting portion of the magnetically resistive segment and is engaged with the press fitting portion of the stationary core, wherein an inner diameter of the connecting portion of the second magnetic segment is substantially the same as the inner diameter of the connecting portion of the magnetically resistive segment; and a receiving portion that extends from the connecting portion of the second magnetic segment on an upstream side of the connection portion of the second magnetic segment and has an inner diameter larger than the inner diameter of the connecting portion of the second magnetic segment, wherein the receiving portion of the second magnetic segment is radially spaced away from the stationary core.

* * * * *

UNITED STATES PATENT AND TRADEMARK OFFICE

CERTIFICATE OF CORRECTION

PATENT NO. : 6,889,919 B2
DATED : May 10, 2005
INVENTOR(S) : Matsuo et al.

It is certified that error appears in the above-identified patent and that said Letters Patent is hereby corrected as shown below:

Title page,
Item [75], Inventors,
"[75] Inventors: Tetsuharu Matsuo
Yoshinori Yamashita
Takayuko Hokao" should be
-- [75] Inventors: Tetsuharu Matsuo
Yoshinori Yamashita --.

Signed and Sealed this

Sixteenth Day of August, 2005

JON W. DUDAS
*Director of the United States Patent and Trademark Office*